US010934067B1

(12) United States Patent
Cristea, Jr.

(10) Patent No.: US 10,934,067 B1
(45) Date of Patent: Mar. 2, 2021

(54) SANITARY COVERS FOR DRINK CONTAINERS AND METHOD

(71) Applicant: William J. Cristea, Jr., Valparaiso, IN (US)

(72) Inventor: William J. Cristea, Jr., Valparaiso, IN (US)

( * ) Notice: Subject to any disclaimer, the term of this patent is extended or adjusted under 35 U.S.C. 154(b) by 0 days.

(21) Appl. No.: 15/929,838

(22) Filed: May 26, 2020

(51) Int. Cl.
*B65D 51/12* (2006.01)

(52) U.S. Cl.
CPC ..... *B65D 51/12* (2013.01); *B65D 2401/15* (2020.05)

(58) Field of Classification Search
CPC .... B65D 51/12; B65D 2401/15; B65D 51/02; B65D 51/185; B65D 55/08; B65D 59/04
USPC ..... 383/200, 37, 35, 1, 907, 77; 220/495.03; 229/89–91; 150/154; 206/409
See application file for complete search history.

(56) References Cited

U.S. PATENT DOCUMENTS

| | | | | |
|---|---|---|---|---|
| 3,762,542 | A * | 10/1973 | Grimes | A61J 9/008 206/525 |
| 3,979,050 | A * | 9/1976 | Cilia | B65D 33/002 383/35 |
| 4,651,890 | A | 3/1987 | Coker et al. | |
| 5,014,869 | A | 5/1991 | Hammond | |
| 5,762,948 | A | 6/1998 | Blackburn et al. | |
| 6,001,441 | A | 12/1999 | Plizzano | |
| 6,450,358 | B1 | 9/2002 | Berro | |
| 6,578,731 | B1 | 6/2003 | Lewis et al. | |
| 6,836,920 | B1 | 1/2005 | Scannell | |
| 7,605,096 | B2 | 10/2009 | Tomarchio et al. | |
| 7,838,447 | B2 | 11/2010 | Clark et al. | |
| 9,162,798 | B2 | 10/2015 | Hands | |
| 10,351,998 | B2 | 7/2019 | Baer et al. | |
| 2002/0043473 | A1 | 4/2002 | Lee et al. | |
| 2008/0135581 | A1 * | 6/2008 | Kennedy | B05C 17/002 222/205 |
| 2009/0159604 | A1 | 6/2009 | Buzgau et al. | |
| 2009/0249566 | A1 | 10/2009 | Chalmers | |
| 2010/0000571 | A1 | 1/2010 | Rosenaur | |
| 2012/0279007 | A1 * | 11/2012 | Boorstein | A45D 44/18 15/247 |
| 2016/0009458 | A1 | 1/2016 | Diaz Mason | |
| 2016/0235057 | A1 * | 8/2016 | Qiu | A01N 25/10 |

FOREIGN PATENT DOCUMENTS

| | | | |
|---|---|---|---|
| DE | 102013005461 | A1 | 2/2014 |
| WO | 0105669 | A1 | 1/2001 |
| WO | 2015036800 | A1 | 3/2015 |

* cited by examiner

*Primary Examiner* — Rafael A Ortiz
(74) *Attorney, Agent, or Firm* — Riley Intellectual Property Law, LLC

(57) ABSTRACT

A sanitary cover provides an improved way to prevent or lessen the spread of infectious diseases, such as COVID-19, the flu, and/or the common cold, through indirect contact with beverage containers. The sanitary cover includes a sleeve of flexible absorptive fabric that is impregnated with a liquid germicidal disinfectant. The sleeve is sized and shaped to fit onto and over the pour-through opening of a beverage container. A set of connected sanitary covers is formed by an elongate tubular sleeve of the flexible absorptive fabric impregnated with a liquid germicidal disinfectant and divided into individual ones of the sanitary covers by frangible line and a seam formed in the elongate tubular sleeve between each adjacent pair of the sanitary covers.

13 Claims, 3 Drawing Sheets

SANITARY COVERS FOR DRINK CONTAINERS AND METHOD

FIELD

This application relates generally to protective hygienic items and methods, and more specifically to sanitary covers for drink containers and methods of using the same.

BACKGROUND

The spread of biological contagion among a human population by indirect contact due to transmission by contact with aerosolized and non-aerosolized fluids from an infected person can cause significant risks to both personal health of individuals as well as result in massive economic disturbances and health crises on a larger scale. For example, the spread of the COVID-19 by transmission of the SARS-CoV-2 virus has had devastating impacts to the health systems and economies of nations. It is believed that the COVID-19 virus is primarily transmitted between people through respiratory droplets and contact routes, typically by direct contact with infected people and indirect contact with surfaces in the immediate environment or with objects used on the infected person.

One way to prevent the spread of transmittable diseases, such as COVID-19, the flu, or the common cold, is to prevent the transmission of the underlying pathogen, such as the SARS-CoV-2 virus, via surface transmission on frequently touched surfaces (e.g., door knobs and counter tops). This may be accomplished, for example, by preventing the pathogen from settling on the surface, sanitizing surfaces to remove pathogens that have settled on it, and/or frequently washing hands to remove and/or kill any pathogens that have been picked up through contact with a contaminated surface.

Some surfaces where surface transmission might be of particular concern are surfaces related to ingesting food and/or beverages due to bringing such items in or near the mouth. For this reason, heightened sanitary requirements and practices surrounding the food service industry, and in particular in restaurants, bars, catered event, and even private in-home gatherings, are typical in order to prevent or minimize the risk of spreading disease. Beverage containers, such as beer bottles, soda cans, and water glasses, are particularly in need of having sanitary exterior surfaces, such as the drink surfaces and/or gripping surfaces, because those surfaces are brought into direct contact or into the immediate vicinity of a person's mouth. In particular, although beverage container may be stored in a well cleaned and sanitized condition, there is still the risk of pathogens settling on the surfaces of the beverage container while it is being transported from the storage location to a customer. This may be especially problematic when the space along the transport route is filled with many people, such as in a restaurant, bar, casino, or similar public venue. Therefore, it would be useful to have an easy means for preventing pathogens from settling on the beverage container while it is being transported to a customer.

There have been several designs to provide a way to sanitize, protect, and/or disinfect the drink surfaces of beverage containers. For example, U.S. Patent Application Publication No. 20160009458 discloses a molded bottle cap that fits over the mouth and neck of a bottle and includes a central depression that seats into the mouth of the bottle. An antiseptic strip carrying an antiseptic is disposed inside the cover to contact the rim surrounding the mouth.

WO0105669 discloses a hygienic protective sleeve made of a soft resilient material for covering the opening of a beverage bottle by being pressed onto the mouth of the bottle. U.S. Pat. No. 9,162,798 discloses a beverage can with an antimicrobial wipe contained in a pouch that is adhered to the side of the can. The user can remove the antimicrobial wipe from the pouch and use it to clean and/or disinfect the drink surface in the area of the mouth of the can before drinking from the can. U.S. Pat. No. 5,014,869 discloses a cap to cover the top of a beverage can with an antiseptically saturated sponge disposed between the upper surface of the can and the cap. However, several of these designs are intended to be manufactured and provided with the beverage container, which adds manufacturing cost, and others of these designs do not provide antimicrobial agents.

The present inventor has developed new devices and methods to prevent or reduce the spread of pathogens, such as the SARS-CoV-2 virus, that might be transmitted via the drink surfaces of a beverage container, such as bottle, can, glass, or cup. The devices and methods are relatively simple to manufacture and easy to use. Further, the devices and methods may improve the confidence and feeling of security to customers of restaurants, bars, catered events, and the like that the beverage container they are putting to their lips is sanitary and free of such surface pathogens, such as the SARS-CoV-2 virus, flu virus, cold virus, bacteria, or fungal matter.

SUMMARY

The sanitary covers and methods disclosed hereinafter provide an improved way to prevent or lessen the spread of infectious diseases, such as COVID-19, the flu, and/or the common cold, through indirect contact transmission via beverage containers. The sanitary covers disclosed herein may have particularly helpful application in the hospitality industry, and even more specifically in bars, restaurants, and other modes within the food service industry where beverages are frequently transported by a server through a crowded public space from a storage area to the customer. Proper use of the drink covers may prevent transmission of pathogens on the drink surfaces and other exterior surfaces of a beverage container, such a bottle, drink can, glass, cup, or other similar containers from which a person directly drinks a beverage.

According to some aspects of the disclosure, a sanitary cover for a beverage container includes a sleeve of flexible absorptive fabric that is impregnated with a liquid germicidal disinfectant and that is sized and shaped to fit onto and over the pour-through opening of a beverage container. In one arrangement, the sleeve may have an elongate tubular shape extending along a central axis such that the sleeve surrounds an interior space and extends between opposite first and second ends. The sleeve may have an opening into the interior space disposed at the first end. The sleeve may be closed at the second end. The opening and interior space may be sized to receive the pour-through mouth of the beverage container therein.

According to other aspects of the disclosure, a set of connected sanitary covers is formed by an elongate tubular sleeve of flexible absorptive fabric impregnated with a liquid germicidal disinfectant. The sleeve is divided into at least a first sanitary cover and a second sanitary cover formed along an axial length of the elongate tubular sleeve. A frangible line in the sleeve extends transverse to the axial length of the sleeve and separates the first sanitary cover from the second sanitary cover. The first sanitary cover is connected to the second sanitary cover along the frangible line. A seam may be disposed adjacent the frangible line. The seam may extend transverse to the axial length of the sleeve. The first sanitary cover may be separable from the second sanitary cover along the frangible line. The seam may form a closed end of the first sanitary cover. The frangible line may define an open end of the second sanitary cover when the first sanitary cover is separated from the second sanitary cover. The frangible line may be formed by a line of perforations through the fabric. The perforations may extend across a width of the elongate tubular sleeve transverse to the axial length.

According to additional aspects of the disclosure, a method of sanitizing a beverage container having a pour-through mouth and a drink surface surrounding the pour-through mouth is provided. The method includes removing a sanitary cover according to any aspect disclosed herein from a dispensing container, placing the sanitary cover in an operative protective position over the pour-through mouth, and engaging the drink surface with a portion of the impregnated liquid germicidal disinfectant. In this manner, the sanitary cover covers the pour-through mouth and drink surface in the operative protective position to prevent viral and/or bacterial pathogens from settling onto the drink surface, and the liquid germicidal disinfectant may kill viral and/or bacterial pathogens on the drink surface.

Any one of these aspects and/or arrangements may further include any one or more of the following optional arrangements and/or features in any desired combination thereof.

In some arrangements, the liquid germicidal disinfectant may have an effective amount of active agents sufficient to kill one or more viral pathogens and/or bacterial pathogens on contact. The liquid germicidal disinfectant may be a food grade composition safe for application to drink surfaces of a beverage container. The liquid germicidal disinfectant may include active agents sufficient to kill corona viruses, such as the SARS-CoV-2 virus, on contact. The liquid germicidal disinfectant may be an aqueous mixture including isopropanol, ethanol alcohol, dodecyl dimethyl ammonium chloride, and alkyl dimethyl benzyl ammonium chloride. The aqueous mixture may be substantially composed of less than about 15% isopropanol, less than about 10% ethanol alcohol, about 0.023% dodecyl dimethyl ammonium chloride, and about 0.015% alkyl dimethyl benzyl ammonium chloride.

In some arrangements, the opening and the interior of the sanitary cover are sized and shaped to receive a pour-through mouth and neck of a beverage bottle therein. The length of the sleeve along the axis of the sanitary cover may be less than a height of the beverage bottle. The opening may have a diameter between about 1 inch (2.5 cm) and about 4 inches (10 cm). The sleeve may have a length between about 3 inches (7.5 cm) and about 9 inches (22.5 cm). When the sanitary cover is flat, the opening may have a width of about 2 inches (5 cm) and the sleeve may have a length of about 4 inches (10 cm).

In some arrangements, the opening and the interior of the sanitary cover are sized and shaped to receive a pour-through mouth and top of a drink can therein. The opening may have a diameter between about 2 inches (5 cm) and about 4 inches (10 cm). The sleeve may have a length between about 1 inch (2.5 cm) and about 4 inches (10 cm). The first end may have a straight shape extending across width of the sleeve. The first end may have a contoured shape. The contoured shape may the shape of an arc defining a recessed central area and a protruding wing on each of the two opposite sides of the recessed central area. The second end may have a second contoured shape complementary to the contoured shape at the first end.

In some arrangements, the flexible absorptive fabric includes a ply of non-woven fabric. The non-woven fabric may be formed of a synthetic material, such as polypropylene, nylon, and/or polyester. The flexible absorptive fabric may be provided in the form of an elongate web and formed into the sleeve and sanitary cover form by appropriate folding, securing, and/or cutting. The web may be single ply or have a plurality of plies. Natural fibers and/or fabrics may also be used.

In some arrangements, the second end is closed by a seam extending across a width of the sleeve transverse to the central axis. The seam may be formed by heat weld, stitching, and/or other fastening mechanisms. The seam may form a continuous or intermittent seal completely across the width of the sleeve. In other arrangements, the second end may be closed by an end wall connecting the side wall of the sleeve.

In some arrangements, the opening is defined by a frangible line extending across a width of the sleeve transverse to the central axis. The frangible line may be defined by a plurality of perforations through the sleeve and/or another line of weakness cut, pressed, or otherwise formed in the sleeve wall.

In some arrangements, the elongate tubular sleeve forming the set of connected sanitary covers may be wound in a roll with the first sanitary cover disposed at an exposed end of the roll. In other arrangements, the elongate tubular sleeve may be folded one or more times along its length with the first sanitary cover disposed at an exposed end of the elongate tubular sleeve.

In some arrangements, a set of sanitary covers may be stored within a container to prevent or minimize evaporation of the liquid germicidal disinfectant. The elongate tubular sleeve may be disposed within a dispensing container that prevents evaporation of the liquid germicidal disinfectant. The dispensing container may include a dispensing opening through which a first sanitary cover can be removed from the container and detached from a second sanitary cover without removing the second sanitary cover entirely from the dispensing container.

These and other aspects, arrangements, features, and/or technical effects will become apparent upon inspection of the following detailed description and of the figures.

DETAILED DESCRIPTION

Figure 1:
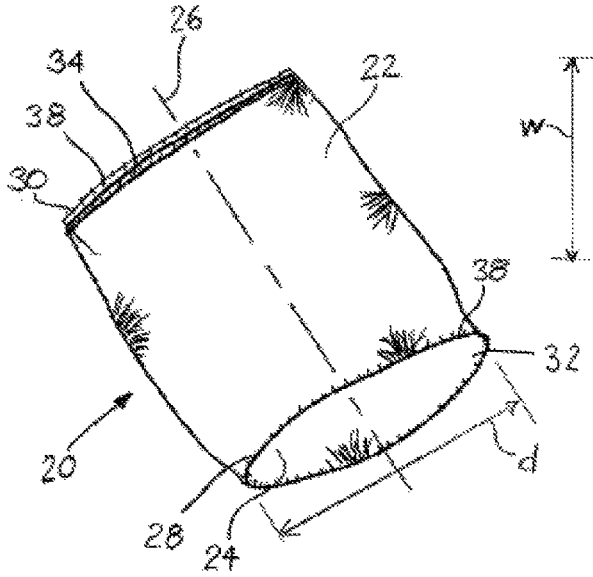
FIG. 1 is an isometric view of a sanitary cover according aspects of the present invention in an expanded configuration.
Figure 2:
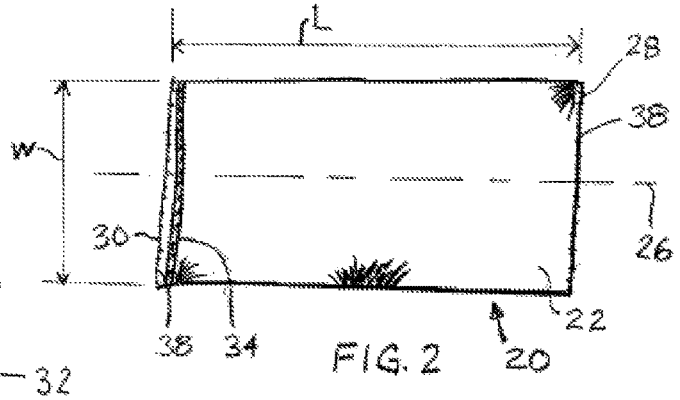
FIG. 2 is a front side view of the sanitary cover in a flat configuration.
Figure 3:
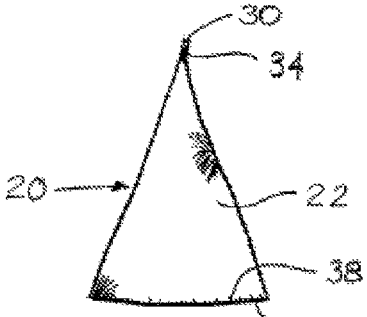
FIG. 3 is a left side view of the sanitary cover in an expanded configuration.

Turning now to the drawings, FIGS. 1-3 show a sanitary cover 20 according to some aspects of the disclosure. The sanitary cover 20 is formed of an elongate tubular sleeve 22 made of flexible absorptive fabric and sized and shaped to fit onto and over a drink-through mouth of a beverage container, such as a beverage bottle or a drink can. The sleeve 22 is impregnated with a liquid germicidal disinfectant. Preferably, the liquid germicidal disinfectant is also safe for food grade applications. When the sanitary cover 20 is placed onto and over the drink-through mouth of a beverage container in a protective position, as shown schematically in FIGS. 4 and 5, the sanitary cover both prevents airborne pathogens from settling onto the drinking surfaces of the beverage container near the drink-through opening and kills pathogens that may already be present on the drinking surfaces. In addition, the sanitary cover 20 can also easily be used to wipe the outer surfaces of the drink container to further clean and/or disinfect the outer surfaces of the beverage container. Thus, the sanitary cover 20 provides a convenient and effective mechanism for preventing the spread of surface transmitted pathogens, such as the SARS-CoV-2 virus, as well as other surface transmitted viruses, bacteria, and/or fungi, depending on the active germicidal ingredients in the liquid germicidal disinfectant, via the drinking surface and other outer surfaces of a beverage container.

The sleeve 22 is defined by a sleeve wall that surrounds an interior space 24 and extends along a central axis 26 from a first end 28 to a second end 30. An opening 32 into the interior space 24 is disposed at the first end 28. Preferably, the opening 32 is defined by an edge of the sleeve wall at the first end 28. For reasons to become clear hereinafter, the opening 32 is defined by a frangible line of weakness 38 in the sleeve wall surrounding the central axis and oriented transverse to the central axis. The frangible line of weakness may be formed by a line of perforations through the sleeve wall or by other mechanism. However, in other arrangements, the opening 32 is formed by without the frangible line of weakness 38.

The second end 30 of the sleeve 22 forms a closed end of the sanitary cover 20. In this example, the second end 30 is closed by a seam 34 that couples opposing portions of the sleeve wall together and extends across the width of the sleeve 22 transverse to the central axis 26. The seam 34 may be formed with adhesive, a heat seal, heat weld, fasteners, sewing, or any other connecting mechanism suitable for use with the material or materials from which the sleeve 22 is made. In the present example, the seam 30 forms a seal extending across the entire width of the sleeve 22. In other examples, the seam 34 may be intermittent and not form a seal across the entire width of the sleeve. The second end 30 may also be closed without a seam, for example as a continuous closed portion of the sleeve wall and/or as an end wall extending across the second end 30 of the sleeve 22.

The sleeve 22 and sleeve wall is made of any fabric that is relatively flexible and can absorb a liquid. In one arrangement, the sleeve 22 is formed of a non-woven synthetic absorptive fabric, such as 5 gsm+/−3 gsm polypropylene non-woven fabric. However, the fabric may be woven or non-woven, and other materials, such as nylon, polyester, and/or natural fibers may be used. In any event, it is preferable that the fabric be flexible enough to be easily rolled and unrolled, folded and unfolded, and slipped over a bottle neck or drink can top by a person. Further, the fabric should be porous enough to retain the liquid germicidal disinfectant for at least 1-2 minutes, and preferably 10-15 minutes, when exposed to the typical interior environment of a restaurant or bar or similar location. The fabric may be a single ply fabric or a multi-ply fabric. The fabric may also include one or more non-absorptive plies, such as a substrate and/or as a backing for one or more absorptive plies. Where the fabric includes a non-absorptive ply, at least one absorptive ply is disposed on at least one exposed side of the sleeve 22, preferably the interior surface of the sleeve.

FIG. 2 shows the sanitary cover 20 in a flat, substantially two-dimensional, condition, whereas FIG. 3 shows the sanitary cover 20 in an expanded, more three-dimensional, condition. The flat condition of FIG. 2 is particularly suitable for storing the sanitary cover 20, whereas the expanded condition of FIG. 3 is suitable for operatively placing the sanitary cover 20 in a protective position onto a beverage container. In the flat condition, the sanitary cover 20 has a substantially rectangular shape with a length L extending along the central axis 26 and a width W orthogonal to the central axis 26. While in the flat condition, the opening 32 has a flat width that is larger than a diameter or width of the opening when in the expanded condition. Similarly, the length L may be longer in the flattened condition, i.e., a flat length, than in the expanded condition.

Figure 4:
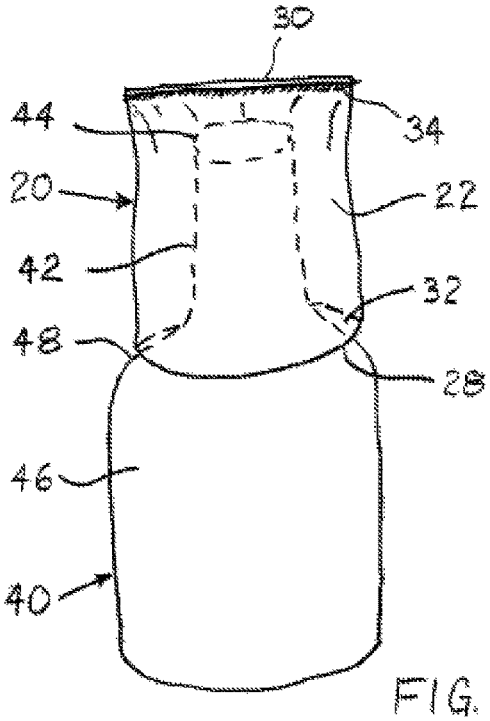
FIG. 4 is an isometric view of the sanitary cover sized and shaped to fit over the mouth and neck of a beverage bottle its operative protective position covering the beverage bottle.
Figure 5:
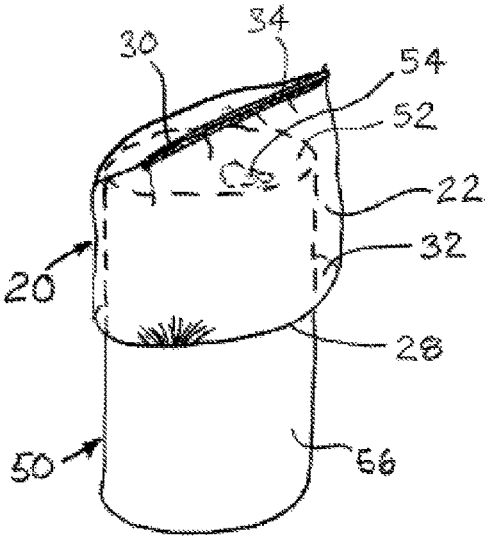
FIG. 5 is an isometric view of the sanitary cover sized and shaped to fit over the top and mouth of a drink can its operative protective position covering the drink can.

As shown in FIGS. 4 and 5, the opening 32 at the first end 28 is sized to receive the mouth of a beverage container therein, such as the drink-through opening and neck of a typical beverage bottle or the top of a typical beverage can, when the sanitary cover 20 is disposed in its operative protective position over the mouth of the container. Preferably, the opening 32 and the sleeve 22 are sized to fit relatively closely around the outer circumference of the beverage container in the area near and surrounding the drink-through mouth. The sleeve 22 preferably has a length along its central axis 26 that is shorter than the height of the beverage container so that the sleeve 22 does not extend all the way to the bottom of the beverage container when disposed in its operative protective position over the mouth of the container. In this way, the sanitary cover 20 is sized and shaped to so that the first end of the sleeve 22 does not contact the support surface under the bottom of the beverage container, which further improves the sanitary protective properties of the sanitary cover 20.

FIG. 4 shows an example of the sanitary cover 20 sized and shaped to cover a beverage bottle 40, such as a standard North American 12 oz. (355 mL) long neck beer bottle. The sanitary cover 20 slips onto and fits closely around the neck 42 so that the closed end 30 covers the pour-through mouth 44 and the sleeve 22 surrounds the neck 42. In this arrangement, the sleeve 22 and the opening 32 preferably have the same diameter, which is larger than the outside diameter of the neck 42 and less than the outside diameter of the main body 46 of the bottle. Thus, the sleeve 22 and the opening 32 preferably have a diameter between about 1 inch (2.5 cm)

and about 4 inches (10 cm). The sleeve 22 has a length sufficient to extend down to about the shoulder 48 of the beverage bottle 40 when fitted over the pour-through mouth 44 and neck 42. In other arrangements where the opening 32 and sleeve 22 are larger than the diameter of the main body 46, the sleeve 22 may have a length that extends from the pour through mouth 44 part-way down the height of the main body 46. For example, the sleeve preferably has a length between about 1 inch (2.5 cm) and about 9 inches (22.5 cm). In the present arrangement, the sleeve 22 when flat has width of about 2 inches (5 cm) a length of about 4 inches (10 cm), which is a size and shape that allows the sanitary cover 20 to easily slide onto cover the neck 42 and pour-through mouth 44 without touching a support surface under the bottom of the beverage bottle 40. However, the size of the opening 32 and the diameter of the sleeve 22 may be larger or smaller, depending on the size of the beverage bottle 40, so long as the sanitary cover 20 fits reasonably closely over and around the neck 42 and the pour-through mouth 44.

FIG. 5 shows an example of the sanitary cover 20 sized and shaped to cover a typical cylindrical drink can 50, such as a standard North American 12 fl. oz. (355 ml) drink can. The sanitary cover 20 slips over and fits closely around the top 52 of the drink can 50. The closed second end 30 covers the pour-through mouth 54 of the drink can 50, and the wall of the sleeve 22 surrounds an upper portion of the sidewall 56 of the drink can 50. In this example, the sleeve 22 and the opening 32 have the same diameter, which is larger than the outside diameter of the side wall 56. The sleeve 22 and the opening 32 preferably have a diameter between about 2.6 inches (6.5 cm) and about 4 inches (10 cm). The sleeve 22 has a length sufficient to extend part-way down the side wall 56 of the drink can 50 when fitted over the pour-through mouth 54 and top 52 without touching a support surface under the bottom of the drink can 50. In this example, the sleeve 22 has a length preferably between about 2 inches (5 cm) and about 5 inches (12.5 cm). In one arrangement, the sleeve when flat has a length of about 4 inches and a width of about 4.7 inches (11.8 cm). However, the opening 32 and/or the sleeve 22 may have larger or smaller diameters in other arrangements. depending on the size of the drink can 50.

The liquid germicidal disinfectant is able to kill pathogens on contact and is a food grade composition safe for application to drink surfaces of a beverage container in a restaurant or bar. Preferably, the liquid germicidal disinfectant is sufficient to kill bacteria and/or viruses upon contact. The liquid germicidal disinfectant preferably contains an effective amount of active agents sufficient to kill corona viruses on contact. In some arrangements, the disinfectant is sufficient to kill viruses that cause cold, flu, Covid19, SARS, MERS, and/or other similar contagions. In one example, the liquid germicidal disinfectant is an aqueous mixture including isopropanol, ethanol alcohol, dodecyl dimethyl ammonium chloride, and alkyl dimethyl benzyl ammonium chloride in amounts effective to kill viral and/or bacterial pathogens as described herein and safe for application to drink surfaces of a beverage container in a restaurant or bar. A liquid germicidal disinfectant according to one example believed to meet these criteria is an aqueous mixture composed of less than about 15% isopropanol, less than about 10% ethanol alcohol, about 0.023% dodecyl dimethyl ammonium chloride, and about 0.015% alkyl dimethyl benzyl ammonium chloride. In some arrangements, the liquid germicidal disinfectant is or may include an alcohol-based sanitizer consisting of a) at least 94% alcohol by volume, wherein the alcohol is either ethanol or United States Pharmacopeia Isopropyl alcohol, b) Glycerin (glycerol) USP or Food Chemical Codex (FCC) (also known as "food grade"), hydrogen peroxide, and sterile water. In some arrangements, the alcohol-based sanitizer may have the formula a) alcohol (ethanol) (formulated to 80%, volume/volume (v/v)) in an aqueous solution; or isopropyl alcohol (formulated to 75%, v/v) in an aqueous solution; b) glycerin (glycerol) (1.45% v/v); c) hydrogen peroxide (0.125% v/v); and d) sterile distilled water or boiled cold water. In any alcohol-based sanitizer, the alcohol may be denatured. These particular liquid germicidal disinfectants are exemplary only and not meant to be limiting. Other active components and/or effective amounts of components that are safe for use on food surfaces and are sufficient to disinfect the surfaces of the beverage container from bacteria and/or viruses may be used in the liquid germicidal disinfectants.

Figure 6:
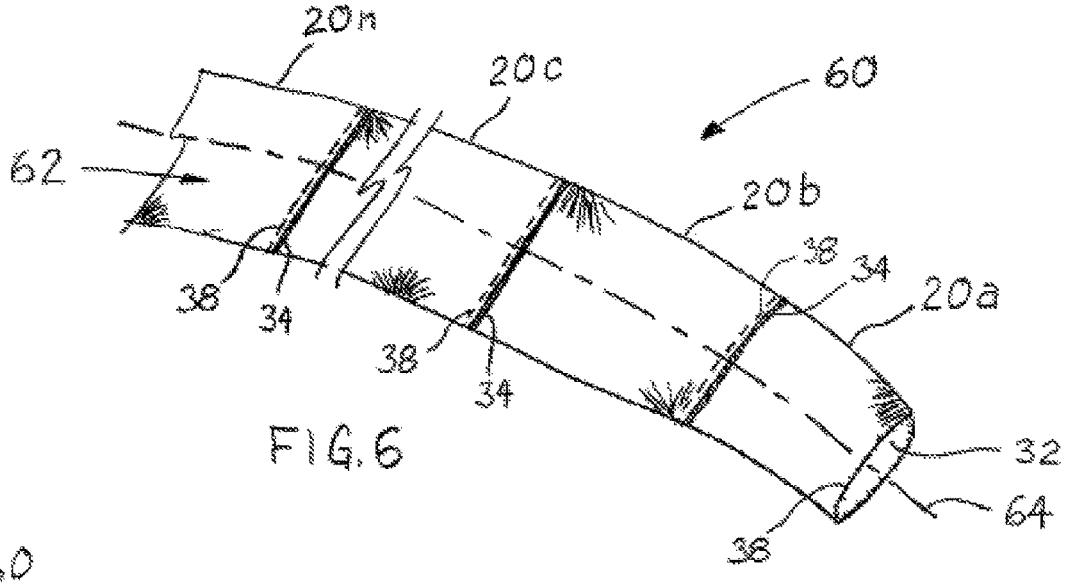
FIG. 6 is an isometric view of a set of connected sanitary covers formed by an elongate tubular sleeve according to another aspect of the invention.

FIG. 6 shows a plurality of the sanitary covers 20 provided as a set 60 of connected sanitary covers 20. This may be a particularly suitable and/or convenient form for providing a number of the sanitary covers 20 to a consumer. The set 60 is formed by an elongate tubular sleeve 62 of flexible absorptive fabric. The fabric may be any of the fabrics described previously herein. The fabric is impregnated with a liquid germicidal disinfectant as described previously herein. The sleeve 62 is divided into a plurality of the sanitary covers 20, including at least a first sanitary cover **20*a* and a second sanitary cover 20*b*, formed along the length of the central axis 64 of the elongate tubular sleeve 62. In this example, the first sanitary cover 20*a* is connected to the second sanitary cover 20*b*, which is connected to a third sanitary cover 20*c*, and so on until a last sanitary cover 20*n* along the length of the elongate tubular sleeve 62. The elongate tubular sleeve 62 may be divided into essentially any number n of interconnected sanitary covers 20*a*-20*n*, depending on the length of the elongate tubular sleeve 62. Each adjacent pair of the sanitary covers 20*a*-20*n* along the length of the elongate tubular sleeve 62 is separated by a seam 34 and a frangible line of weakness 38. Each sanitary cover 20*a*-20*n* can be easily separated from the adjacent sanitary cover(s) by tearing along the frangible line of weakness 38 extending between the two adjacent sanitary covers. Thus, for example, the first sanitary cover 20*a* at the end of the elongate tubular sleeve 62 may be easily removed from the remaining portions of the elongate tubular sleeve 62 by simply pulling and tearing the sanitary cover 20*a* along the frangible line of weakness 38**.

Focusing now on the adjacent first and second sanitary covers **20*a* and 20*b*, the frangible line of weakness 38 in the sleeve 62 extends transverse to the central axis 64 of the elongate tubular sleeve 62 and separates the first sanitary cover 20*a* from the second sanitary cover 20*b*. The frangible line of weakness 38 is preferably a line of perforations through the fabric of the sleeve wall; however, other means for producing a frangible line of weakness may be used. The seam 34 of the first sanitary cover 20*a* is disposed adjacent to the frangible line of weakness 38 and also extends transverse to the central axis 64 of the sleeve. Preferably, the seam 34 is parallel to the frangible line of weakness 38, and both are disposed orthogonal to the central axis 64. However, in other arrangements, such as curved seams 34 and/or curved frangible lines 38 are also possible. The seam 34 thereby forms the closed end 30 of the first sanitary cover 20*a*. When the first sanitary cover 20*a* is separated from the second sanitary cover 20*b* along the frangible line of weakness 38, the frangible line of weakness 38 then forms the opening 32 into the second sanitary cover 20*b*. This arrangement of the frangible line of weakness 38 and the seam 34 is repeated between each successive pair of adjacent sanitary covers along the length of the elongate tubular sleeve 62. In this way, individual sanitary covers 20***a*-20*n* may be easily dispensing from the end of the elongate tubular sleeve 62 until the last sanitary cover 20*n* is reached.

The elongate tubular sleeve may be formed of any absorptive flexible fabric as described herein. In this example, the elongate tubular sleeve 62 is formed of synthetic fabric, such as a non-woven polypropylene. The seams 34 may be formed as heat welds and/or heat seals formed by a hot bar pressed onto the fabric. The frangible lines of weakness 38 may be formed by pressing, stamping, or cutting, for example forming perforations or other frangible structures into the fabric. This provides for a relatively fast and simple way to form the set 60 from an elongate tubular sleeve of the fabric.

Figure 7:
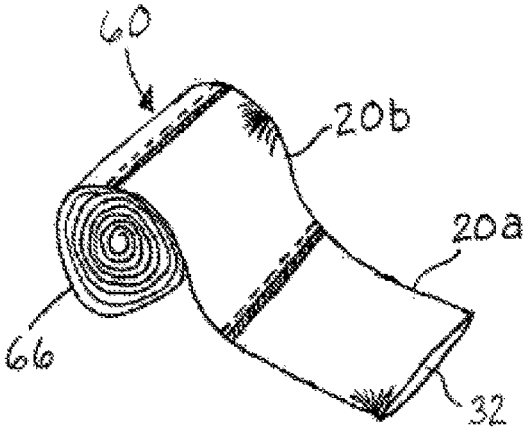
FIG. 7 is an isometric view of the set of connected sanitary covers in a roll configuration.
Figure 8:
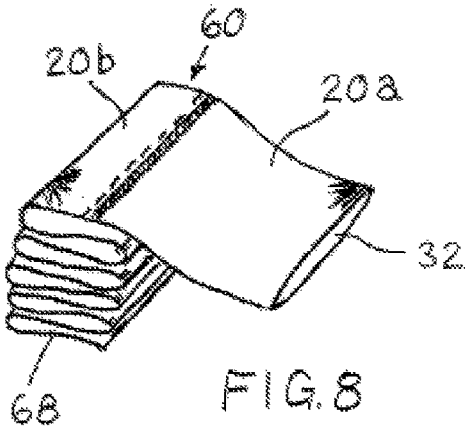
FIG. 8 is an isometric view of the set of connected sanitary covers in a folded configuration.

FIG. 7 shows the set 60 of sanitary covers wound into a roll form. The elongate tubular sleeve 62 is wound in a roll 66 with the first sanitary cover 20*a* disposed at an exposed end of the roll. FIG. 8 shows the set 60 of sanitary covers disposed in a folded form. The elongate tubular sleeve 62 is folded along multiple times along its length into a folded stack 68 with the first sanitary cover 20*a* disposed at an exposed end of the elongate tubular sleeve 62. Other forms, such as a serpentine form for example, are also possible.

Figure 9:
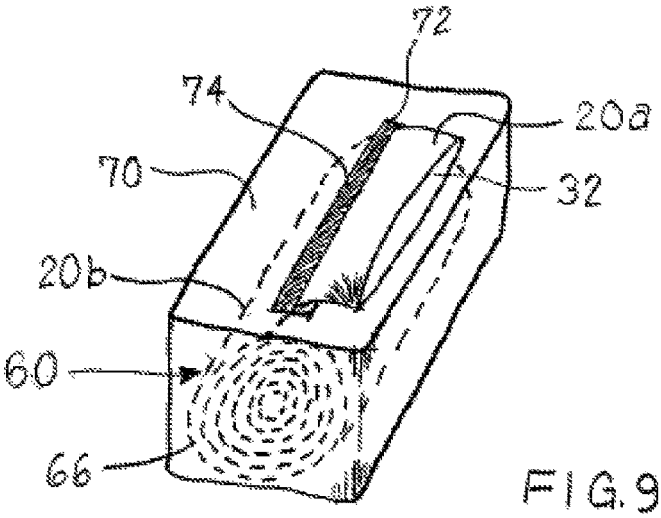
FIG. 9 is an isometric view of the set of connected sanitary covers disposed in a dispensing container.

FIG. 9 shows one possible exemplary arrangement of a set of sanitary covers stored within a container that prevents or slows evaporation of the liquid germicidal disinfectant in order to prolong the useful life of the sanitary covers. The set 60 of sanitary covers 20 having the elongate tubular sleeve 62 wound into a roll 66 is stored inside a dispensing container 70. The dispensing container 70 is an enclosed container that prevents evaporation of the liquid germicidal disinfectant into the surrounding environment. A dispensing opening 72 is disposed through a wall of the dispensing container 70 and is sized to allow the sanitary cover 20*a* disposed at the end of the roll 66 to be pulled out of the container. Preferably, a resilient seal 74 surrounds the dispensing opening 72 and defines a narrow slit through which the sanitary cover 20*a* is pulled. The resilient seal 74 is configured to form a light seal against and surrounding the sanitary cover 20*a* when in the slit to minimize evaporation of the liquid germicidal disinfectant in the roll 66 of sanitary covers 20. The resilient seal 74 may also be configured to lightly resist removal of the elongate tubular sleeve 62 enough to prevent the sanitary covers from falling out of the dispensing opening unintentionally. The resistance provided by the resilient seal 74 may also make it easier for a user to separate the first sanitary cover 20*a* at the end of the roll 66 from the adjacent, second sanitary cover 20*b*, when the first sanitary cover 20*a* has been pulled entirely out of the dispensing opening 72 and the adjacent second sanitary cover 20*b* is only part way out of the dispensing opening. The form of storage and dispensing of the sanitary covers 20 is not limited to the exemplary arrangement shown and described here. Other forms of storing the set of sanitary covers are also possible, such as in a folded form or another a serpentine form. Alternatively, the sanitary covers may be provided as a set that are not connected together, but rather separated from each other and can be withdrawn from a container individually without requiring one to be separated from the other sanitary covers. Different storage and/or dispensing containers may also be used to store and/or dispense the sanitary covers 20.

Figure 10:
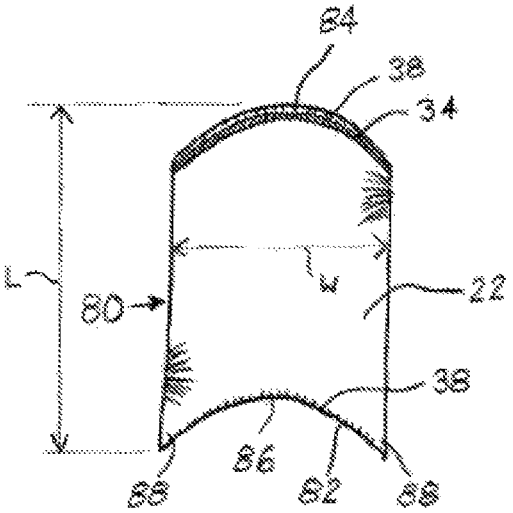
FIG. 10 is a front side view of another sanitary cover in a flat condition according to additional aspects of the invention.
Figure 11:
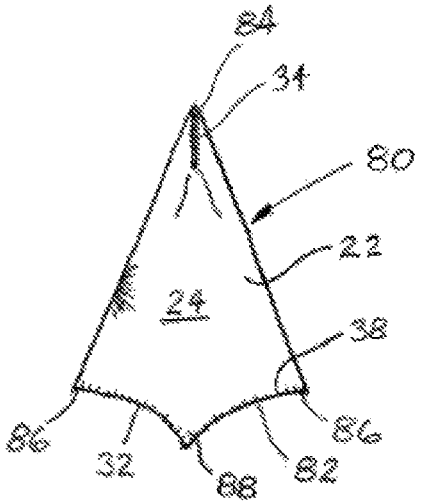
FIG. 11 is a left side view of the sanitary cover of FIG. 10 in an expanded configuration.
Figure 12:
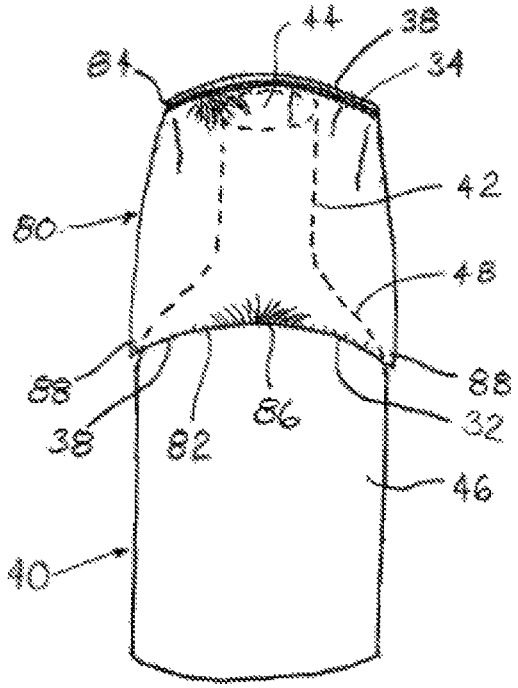
FIG. 12 is a front side view of the sanitary cover of FIG. 10 disposed in its operative protective position over the mouth of the beverage bottle.

Turning now to FIGS. 10-12, a sanitary cover 80 is generally similar to the sanitary cover 20, except that the sanitary cover 80 has a contoured open end 82 and a complementary contoured closed end 84. The contoured open end 82 is shaped to conform more closely to the contour of the shoulder 48 of the beverage bottle 40. Similar to the sanitary cover 20, the sanitary cover 80 is also made of an elongate tubular sleeve 22 of flexible absorptive fabric that is impregnated with a liquid germicidal disinfectant and forms an interior space 24 extending axially from the open end 82 to the closed 84. The flexible absorptive fabric and the liquid germicidal disinfectant may include any of those described previously herein. Substantially similar features and portions of the sanitary cover 80 are numbered the same as with the sanitary cover 20 and reference is made thereto without repeating the descriptions already provided.

As best seen in FIG. 10, in the flat condition, the contoured open end 82 has the shape of an arc defining a recessed central area 86 and a protruding wing 88 on each of the two opposite sides of the recessed central area 86. The arc may be a circular arc or have another geometric shape. The closed end 84 has a curved shape that is complementary to the curved shape of the open end. This allows multiple ones of the sanitary cover 80 to be easily produced from an elongate tubular sleeve similar to the elongate tubular sleeve 62. Thus, each of the contoured open end 82 and the contoured closed end may be defined by a frangible line of weakness 38, such as line perforations, which allows individual ones of the sanitary cover 80 to be separated from a set of connected sanitary covers similar to the set 60. Alternatively, the contoured open end 82 and/or the contoured closed end 84 may be die cut, stamped, heat cut, or otherwise formed, which may be particularly useful if the sanitary cover 80 is to be provided in a fully-separated or un-connected form.

As seen in FIG. 11, in the expanded condition, the contoured open end 82 of the sanitary cover forms a wide, contoured opening into the interior space 24 and the sleeve wall tapers inwardly toward seam 34 at the contoured closed end 84, thereby forming the shape of a cap that fits easily and closely onto and over the pour-through mouth 44 and neck 42 of the beverage bottle 40. Thus, as seen in FIG. 12, when the sanitary cover 80 is disposed in its operative protective position covering the mouth 44 and neck 42 of the beverage bottle 40, the contoured open end 82 conforms more closely to the contour of the shoulder 48 of the beverage bottle 40 when resting on the shoulder. The three-dimensional contour formed by the recessed central area 86 and the protruding wings 88 may help stabilize the sanitary cover 80 on the shoulder 48 in its operative protective position on the beverage bottle 40.

In one arrangement particularly suited for the standard North American 12 oz. (355 mL) long neck beer bottle, the sanitary cover 80 in the flat condition has a width of about 3.14 inches (7.8 cm) and an end-to-end length along the central axis of about 5 inches (12.5 cm). The contoured open end 82 has the shape of an arc with a radius of about 1.625 inches (3.2 cm) and an axial length from the tips of the protruding wings 82 to the apex of the recessed central area 86 of about 1 inch (2.5 cm). The contoured closed end 84 is in the shape of a complementary arc of the contoured open end also with a radius of about 1.625 inches (3.2 cm) and an axial length of about 1 inch (2.5 cm). In this arrangement, the curved open end 82 has a diameter when expanded of about 2 inches (5 cm), which is sized and shaped to fit closely around the neck 42 of the standard North American 12 oz. (355 mL) long neck beer bottle. However, other dimensions may be used to fit to different sizes and shapes of beverage bottles or other beverage containers, such as any of the sizes and beverage containers described elsewhere herein.

The sanitary covers 20, 80 provide an easy way to sanitize a beverage container, such as the beverage bottle 40 or the drink can 50, and/or provide the beverage container to a person who will then drink out of it in a generally sanitary condition. For example, in one possible method, the sanitary cover 20 or 80 is removed from a dispensing container, such as the dispensing container 70. This may be done, for example, by a server in a restaurant or a bartender at a bar when obtaining a drink to serve to a customer in a beverage container. Preferably, the dispensing container is located near to a storage or staging area for the beverage containers from which the server or bartender obtains the beverage containers, such behind the bar or near a cooler where the beverage containers are stored. The sanitary cover is then placed in an operative protective position over the pour-through mouth of the beverage container with the pour-through mouth and the drink surface adjacent the drink-through mouth disposed within the interior space of the sleeve. For example, the server may insert the neck 42 and mouth 44 of the beverage bottle 40, or the top 52 and mouth 54 of the drink can 50, through the opening 32 and into the interior 24 of the sanitary cover 20. Alternatively, the sanitary cover 20 may be operatively placed onto the neck 42 of the beverage bottle 40 or over the top 52 of the drink can 50 by slipping the opening 32 of the sleeve over the neck 42 or top 52 to position the pour-through mouths 44 or 54 in the interior space 24. In this operative protective position, at least a portion of the impregnated liquid germicidal disinfectant is then able to engage the drink surface surrounding the pour-through mouth 44 or 54, which kills at least some pathogens that may be on the drink surface or exterior surface of the beverage container. This action may be easily further by pressing the sleeve 22 against the outer surfaces of the neck 42 or top 52 to further wipe the liquid germicidal disinfectant against the beverage container. In this operative protective position, the sanitary cover covers the pour-through mouth 44 or 54 and the surrounding drink surface, which also prevent viral and/or bacterial pathogens from settling onto the drink surface from the surrounding atmosphere. The beverage container is preferably then transported from the storage area to the customer with the sanitary cover 20 or 80 in the operative protective position. The beverage container may also be served to the customer with the sanitary cover 20 or 80 still covering the pour-through mouth in the operative protective position. In this way, the beverage container is more likely to be in a sanitary condition, free of any pathogens that may have settled onto its surface while being transported to the customer. The customer may also feel more comfortable knowing that the beverage container is more likely to be sanitary. Additionally, the customer may also use the sanitary cover 20 or 80 to further wipe down the beverage container. Thereafter, it is desired to drink from the beverage container, the customer simply removes the sanitary cover 20 or 80 from the beverage container to access the pour-through mouth. The customer may then, if desired, put the sanitary cover back onto the beverage container in the operative protective position to continue protecting the beverage contain from any new pathogens in the surrounding environment. Thus, use of the sanitary covers 20 and 80 in this way can help prevent the spread of diseases.

Any of the sanitary covers 20, 80, or sets 60 described herein may be formed from an elongate web of the flexible absorptive fabric. The web may be folded along its axis and secured into a closed elongate tubular sleeve shape, such as the elongate tubular sleeve 62, for example with a fold on one side of the sleeve and a seam connecting the opposite side edges of the web on the other side of the sleeve. In this way, the web forms the wall of the sleeve. The web may be a single ply of material or have multiple plies. The elongate tubular sleeve may then be formed into one or more of the individual sanitary covers 20, 80 and or a set 60 by forming the seam 34 and frangible lines 38 or other cuts transverse to the axis and across the width of the elongate tubular sleeve in any convenient method.

This detailed description is to be construed as exemplary only and does not describe every possible embodiment or arrangement of features. One could implement numerous alternate embodiments, using either current technology or technology developed after the filing date of this application. Thus, while specific exemplary forms are illustrated and described herein, it is to be understood that any of the various aspects, arrangements, and/or features disclosed herein may be combined with any one or more of the other aspects, arrangements, and/or features disclosed herein in a manner that would be understood by a person of ordinary skill in view of the teachings of this disclosure.

I claim:

1. A sanitary cover for a beverage container, comprising:

a sleeve of flexible absorptive fabric having an elongate tubular shape extending along a central axis, the sleeve surrounding an interior space and extending between opposite first and second ends;

the sleeve having an opening into the interior space disposed at the first end and being closed at the second end;

wherein the sleeve is impregnated with a liquid germicidal disinfectant;

wherein the opening and interior space are sized to receive a pour-through mouth of a beverage container therein; and wherein the liquid germicidal disinfectant comprises an aqueous mixture composed substantially of isopropanol, ethanol alcohol, dodecyl dimethyl ammonium chloride, and alkyl dimethyl benzyl ammonium chloride in effective amounts to kill viral and/or bacterial pathogens on contact.

2. The sanitary cover of claim 1, wherein the fabric comprises synthetic non-woven absorptive fabric.

3. The sanitary cover of claim 2, wherein the liquid germicidal disinfectant is a food grade mixture comprising active agents sufficient to kill the SARS-CoV-2 virus on contact.

4. The sanitary cover of claim 1, wherein the opening and the interior are sized and shaped to receive a pour-through mouth and neck of a beverage bottle therein.

5. The sanitary cover of claim 4, wherein the length of the sleeve along the axis is less than a height of the beverage bottle.

6. The sanitary cover of claim 1, wherein the opening and the interior are sized and shaped to receive a pour-through mouth and top of a drink can therein.

7. The sanitary cover of claim 2, wherein the flexible absorptive fabric comprises a plurality of plies.

8. The sanitary cover of claim 1, wherein the second end is closed by a seam extending across a width of the sleeve transverse to the central axis.

9. The sanitary cover of claim 1, wherein the opening is defined by a frangible line extending across a width of the sleeve transverse to the central axis.

10. The sanitary cover of claim 1, wherein the first end has a contoured shape.

11. The sanitary cover of claim 10, wherein the contoured shape has the shape of an arc defining a recessed central area and a protruding wing on each of the two opposite sides of the recessed central area.

12. The sanitary cover of claim 10, wherein the second end has a second contoured shape complementary to the contoured shape at the first end.

13. The sanitary cover of claim 1, wherein the fabric has a porosity sufficient to retain the liquid germicidal disinfectant for between 1 minute and 15 minutes.

* * * * *